US005689542A

United States Patent [19]

Lavering et al.

[11] Patent Number: 5,689,542

[45] Date of Patent: Nov. 18, 1997

[54] X-RAY GENERATING APPARATUS WITH A HEAT TRANSFER DEVICE

[75] Inventors: Gordon R. Lavering, Belmont, Calif.; Robert C. Treseder, Salt Lake City, Utah

[73] Assignee: Varian Associates, Inc., Palo Alto, Calif.

[21] Appl. No.: 660,617

[22] Filed: Jun. 6, 1996

[51] Int. Cl.[6] ..... H01J 35/06

[52] U.S. Cl. ..... 378/142; 378/141; 378/130

[58] Field of Search ..... 378/119, 121, 378/130, 137, 138, 140, 142, 154, 199, 200

[56] References Cited

U.S. PATENT DOCUMENTS 4,309,637 1/1982 Fetter ..... 313/60

5,165,093 11/1992 Miller et al. ..... 378/138

*Primary Examiner*—Don Wong

*Attorney, Agent, or Firm*—Bella Fishman

[57] ABSTRACT

The present invention provides an X-ray generating apparatus with a shield structure having an electron beam collimating aperture and heat transfer device. The shield structure is made of thermally conductive material and placed in the discharge space between an electron source and rotating anode target. The shield structure is formed by a concave top surface facing the electron source, a flat top surface facing the anode target, and inner and outer walls wherein a linear dimension of the inner wall is substantially smaller than the linear dimension of the outer wall. The inner wall surrounds the beam collecting aperture. The heat transfer device is placed in a beveled portion of the shield structure. The heat transfer device includes an extended coiled wire formed from thermally conductive material and conductively attached to the knurled interior of the shield structure to transfer heat to the cooling liquid passing through inflow and outflow chambers of the shield structure.

35 Claims, 4 Drawing Sheets

X-RAY GENERATING APPARATUS WITH A HEAT TRANSFER DEVICE

FIELD OF THE INVENTION

This invention relates to a high-powered X-ray generating apparatus and, more particularly, to fluid-cooled X-ray generating tubes with rotatable anode assembly.

BACKGROUND OF THE INVENTION

Recent advantages in X-ray detector digital signal processing, image reconstruction algorithms and computing power have allowed the development of fast and reliable helical CT scanners. The speed and rapidity with which CT scanners perform depend on the X-ray tubes' reliability. X-ray tube operations are limited by temporary shut-down of the CT scanner to permit the X-ray tube to cool down between scans.

Conventional X-ray generating tubes, well known in the art, consist of an outer housing containing a vacuum envelope. The evacuated envelope comprises axially spaced cathode and anode electrodes. X-rays are created during the rapid deceleration and scattering of electrons in a target material of high atomic number, such as tungsten or rhenium. The electrons are launched from a hot tungsten filament and gain energy by traversing the gap between the negatively charged cathode and the positively charged anode target. The electrons strike the surface of the track with typical energies of 120–140 keV. Only a tiny fraction of the kinetic energy of the electrons upon striking the target is converted to X-rays, while the remaining energy is convened to heat. As a result the material in the focal spot on the target can achieve temperatures near 2400° C. for a few microseconds of exposure. In any but the smallest X-ray tubes the anode rotates inside the vacuum to spread this heat zone over a large area called the focal track. Attempts to increase electron beam power for better system performance also increase this focal track temperature to even higher values leading to severe stress induced cracking of the focal track surface. This cracking results in shortened life of the X-ray generating apparatus. When the focal track is bombarded with a stream of energetic electrons, about 50% of these incident electrons back-scatter therefrom. Most of these backscattered electrons leave the surface of the target with a large proportion of their original kinetic energy and will return to the anode at some distance from the focal spot producing X-rays. An additional radiation, known as off-focal radiation created by this back-scattering effect, is of lower intensity and can degrade image quality. The off-focal radiation not only complicates CT system imaging, but adds to the heat load of the X-ray tube target. Some backscattered electrons have enough energy and the proper velocity orientation to strike the wall of the evacuated envelope or even the X-ray window which is made with a low atomic number material such as beryllium. These latter electrons heat the vacuum envelope and the beryllium window. When the heated components within the structure of the evacuated envelope reach about 350° C. the cooling oil which is outside the evacuated envelope and which is circulating in contact therewith will begin to boil and break down. The boiling process may create imaging artifacts and the oil breakdown forms carbon which deposits and accumulates with time on both the X-ray window and the walls of the evacuated envelope.

It is also known that when X-rays are produced by bombarding an anode target with electrons, the vast majority of the electron energy is transferred into heat, which must eventually be dissipated to the ambient via the liquid coolant.

In the conventional X-ray generating apparatus designs a circulatory coolant and electrically insulating fluid such as oil is directed through the tube housing. In the tube design disclosed by Fetter (U.S. Pat. No. 4,309,637) the cooling oil circulates through the passages in the shaft of the anode assembly. As a further improvement, a shroud is provided around the anode target for reducing the effect of the off-focal radiation. While such design has some advantages, the shroud is extended towards the electron source, and the electron beam travels through an aperture in the shroud towards the anode target. The shroud in the Fetter design is made hollow which allows the cooling oil to pass therethrough. The shroud creates a long drift region which results in defocusing the electron beam. The configuration of the shroud causes low flow velocity of the cooling fluid where convective heat transfer is most needed. Moreover, the length between anode and cathode of the tube increases dramatically impacting the overall size of the tube.

Therefore it is an object of the present invention to provide an X-ray generating apparatus with improved cooling system which substantially reduces the above referenced major constraints related to X-ray generating apparatus performance.

It is still another object of the present invention to provide a shield structure comprising a coiled heat transfer device incorporated therein to locally increase velocity of the cooling fluid passing therethrough and enhance area in a critical heat exchange location for effective anode target cooling and minimize structural heating from the off-focus radiation by backscattered electrons.

It is yet another object of the present invention to provide an X-ray generating apparatus with extended life time to permit continuous operation with increased power dissipation.

SUMMARY OF THE INVENTION

It is an object of the present invention to provide an X-ray generating apparatus with a shield structure having a pair of chambers for circulating the cooling fluid which is placed between an anode target and an electron source. A shield structure is disposed between the anode assembly and the electron source. The shield structure comprises a body with an aperture for passing the electron beam; inflow and outflow chambers with a septum therebetween for circulating coolant within the inflow and outflow chambers. The inflow and outflow chambers are proximate to the anode target and electron source respectively and a heat transfer device disposed therewith for assisting in dissipating the heat produced by the shield structure.

The shield structure comprises a body which is formed by a concave top surface facing the electron source, a flat bottom surface facing the anode target and an outer and an inner wall, where the outer wall has a higher linear dimension than the inner wall, while the inner wall defines an electron beam aperture. The shield structure further comprises inflow and outflow chambers with a flow divider therebetween. The heat transfer device comprises an extended coil wire forming a channel for cooling fluid which is forced to flow through the coil in a radial direction.

According to one of the embodiments of the present invention the coil wire is placed within a beveled portion of the shield structure which surrounds the electron beam aperture.

According to another embodiment of the present invention, the heat transfer device comprises a plurality of extended coils and the interior of the shield structure has a plurality of furrows to dispose a respective plurality of extended coil wires therein disposed radially within the shield structure.

According to another aspect of the invention, there is provided a method for improved heat transferring from an anode target in an X-ray generating apparatus comprising an evacuated envelope with an electron source for generating the electron beam and an anode target for decelerating the electrons of the electron beam and producing X-rays. The method for improved heat transferring comprises the steps of structuring a shield assembly having a body with a coiled heat transfer device incorporated therein and an electron beam aperture, and placing this assembly between the anode target and a electron source.

The foregoing and other objects and advantages of the invention will appear from the following description. In the description, reference is made to the accompanying drawings which form a part hereof, and in which there is shown by way of illustration a preferred embodiment of the invention.

DESCRIPTION OF THE PREFERRED EMBODIMENTS

Figure 1:
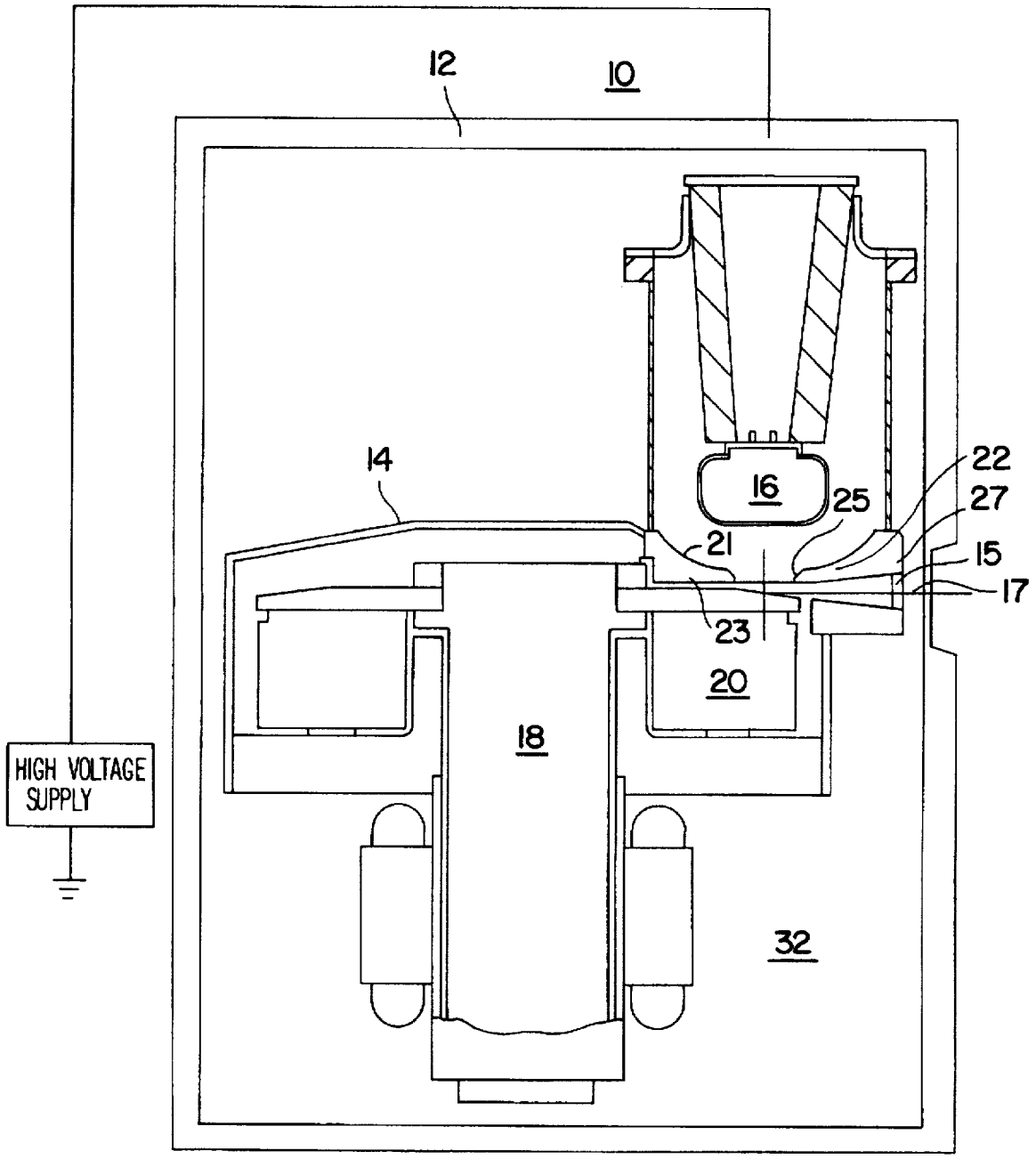
FIG. 1 is a cross-sectional view of the X-ray generating apparatus incorporating the present invention.
Figure 2:
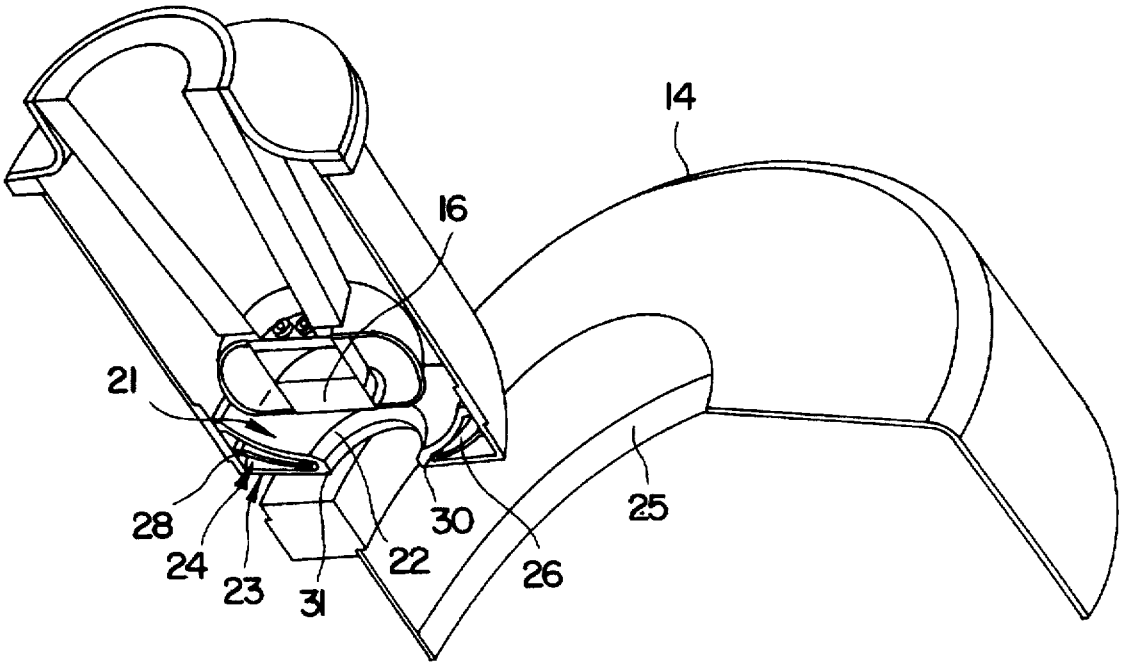
FIG. 2 is a partially cut away isometric view of the present invention showing a shield structure.
Figure 3A:
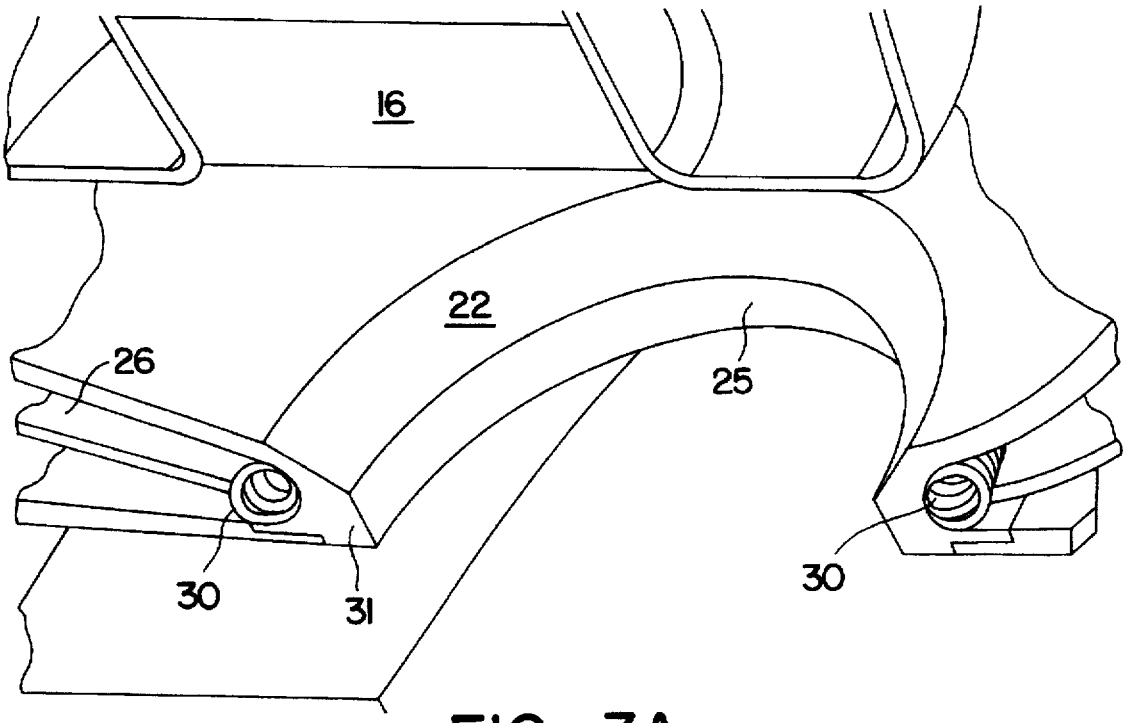
FIG. 3A is a partially cut away isometric view of a shield structure with incorporated heat transfer coiled wire.

Referring specifically to FIG. 1 of the accompanying drawings, there is shown X-ray generating apparatus 10 including housing 12 with evacuated envelope 14. The evacuated envelope comprises electron source 16 and rotatable anode assembly 18 having target 20. Shield structure 22 shown is placed between anode target 20 and electron source 16. Shield structure 22 has concave top surface 21 facing electron source 16, flat bottom surface 23 facing anode target 20, inner wall 25 and outer wall 27. Outer wall 27 of the shield structure is higher in linear dimension than an inner wall 25 thereof. The inner wall of the shield structure defines an aperture for passing a beam of electrons generated by the electron source. As shown in FIG. 2, shield structure 22 has a body which is formed by concave top surface 21 which faces electron source 16, and flat bottom surface 23. Shield structure 22 comprises inflow chamber 24 and outflow chamber 26 with flow divider 28 therebetween. Coiled wire 30 is placed within a beveled portion of the shield structure which defines a tip as shown in FIG. 3A. The interior of shield structure 22 is knurled to increase heat transfer between the shield structure and the cooling liquid passing therethrough. Fluid reservoir 32 is disposed within housing 12 downstream of shield structure 22. The space between the housing and evacuated envelope may be utilized for the cooling fluid.

In operation, the electron beam from electron source 16 impinges on the rotating anode target for generating X-rays which escape through the respective windows 15 and 17 in evacuated envelope 14 and housing 12. The impinging electron beam heats target 20. Heat is radiated by target 20 to evacuated envelope 14. The shield structure substantially reduces the anode target heat load by conducting heat to the cooling liquid flow through coiled wire 30. Coiled wire 30 in shield structure 22 increases wetted area and serves to locally increase the velocity and, therefore, the local turbulence of the cooling fluid which are critical parameters in multi-phase convective cooling. Multi-phase cooling utilizes high velocity, moderate temperature bulk liquid coolant to scrub, or shear away local vapor pockets or bubbles from a heated surface. These gaseous phase bubbles are immediately condensed by the cooler bulk fluid and the net heat load is thus removed from the heated surface with only a moderate rise in the bulk coolant temperature. Thus, the heat of vaporization converting only a small percentage of the bulk liquid phase coolant to its vapor phase removes the greatest percentage of the heat load from both the wetted surfaces of the coiled wires and the inter-coil surfaces of the "furrows". An increased velocity of the coolant flowing over the heated surface allows for the local, small vapor bubbles to be swept away from the liquid contacted heat exchange surface before they have a chance to coalesce with neighboring bubbles and form a thermal runaway vapor film. To achieve this result, the local velocity should be at least 4 feet/second, and preferably more than 8 feet/second. Such a velocity is required in the region of peak heat flux only, while in the other regions it causes an unnecessary increased pressure drop in the cooling system. Coiled wire also helps to increase the turbulent kinetic energy of the cooling fluid passing therethrough. High turbulent kinetic energy augments the formation of turbulent eddies and increases the velocity gradient normal to the wetted surface, both contributing to improved heat transfer. The interior or fluid cooled side of the tip of the shield structure is made curvilinear so that a minimum wall thickness is gained in combination with streamlined flow over the heat transfer surface. Minimized coiled wire along with the intentionally coupled or interior surface of the shield structure adds additional wetted area to a surface to be cooled and reduces the average heat transfer power density in this region.

Figure 3B:
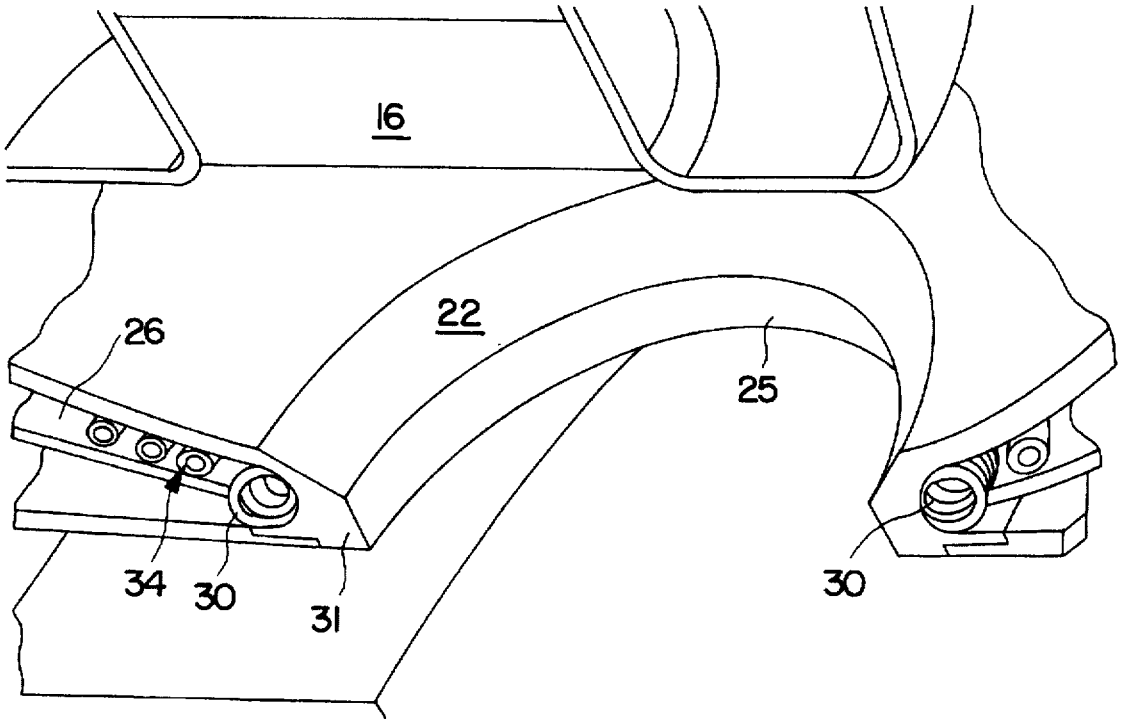
FIG. 3B is a partial cut away isometric view of the shield structure with a plurality of coiled wires incorporated therein.
Figure 4A:
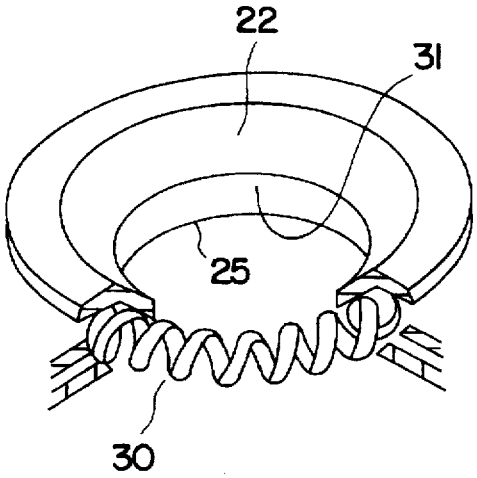
FIG. 4A is an enlarged cut away isometric view of a tip of the shield structure with the coiled wire having coils with circular cross-sections.
Figure 4B:
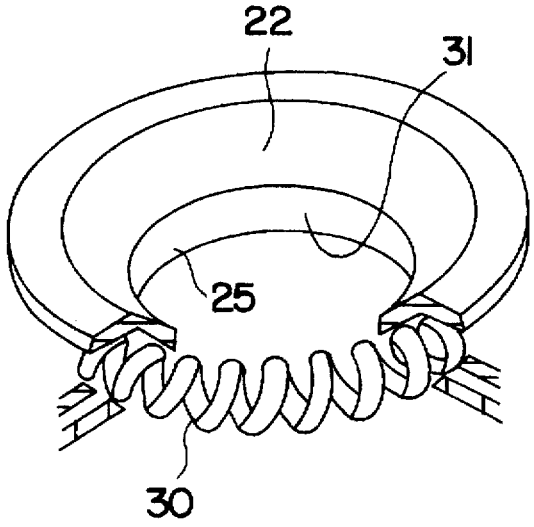
FIG. 4B is an enlarged cut away isometric view of the tip of the shield structure with the coiled wire having coils with non-circular cross-sections.

As shown in FIG. 3B, a plurality of extended coiled wires 34 may be incorporated into outflow chamber 26 of shield structure 22 according to the other embodiment of the present invention. The coiled wires are formed from thermally conductive material, such as copper, for example, as well as the shield structure. Each turn of the plurality of coiled wires can have either a circular or noncircular cross section as shown in FIG. 4A and FIG. 4B respectively. To enhance the cooling performance of the shield structure and increase the heat transfer area, a plurality of furrows are formed in the interior of concave top and flat bottom surfaces of the shield structure for disposing a respective plurality of extended coiled wires. Each turn of the coiled wire is secured to the interior of the shield structure by brazing for increasing thermal conduction therebetween. The arrangement of the coiled wires within the shield structure depends on the designer's choice. Coil wires may be positioned spaced apart from the edge of one coil to the edge of the following coil. Coil wires may be arranged in rows extended radially within outflow and/or inflow chambers, wherein each coil wire is spaced apart from each neighboring one.

In the vast majority of the CT X-ray generating tubes mineral oil is used as a heat transfer medium. The efficient multi-phase cooling of the present invention is enhanced by the use of SylTherm, a special heat transfer fluid manufactured by Dow Chemical Company under this tradename. SylTherm is a modified polydimethylsiloxane. The flow path of the cooling fluid is critical to enhance performance of the X-ray generating apparatus. The flow passing through the coiled wire at the tip of the shield structure must be uniform around the circumference. Any localized "dead spots" with reduced flow velocity would cause overheating thereof, since a vapor film rapidly forms in the locations of low flow velocity and impedes any further heat transfer in that region. To avoid this failure condition, flow is kept symmetric by first entering a large inflow chamber 24 through two spaced apart ports from opposite directions. The cross-section of the inflow chamber 24 is substantially larger than the cross-section of the shield structure tip 31 so that the fluid contained within the inflow chamber is of a uniform pressure compared with the pressure drop across the shield structure. Outflow chamber 26 performs a similar function and equalizes pressure therewithin. From outflow chamber 26, fluid leaves from two symmetrically positioned ports to a fluid reservoir. As a result, the uniform inflow and outflow pressure and the relatively high pressure drop of the shield structure tip ensures that the velocity through the coiled wire is uniform around the circumference of the tip.

Figure 5:
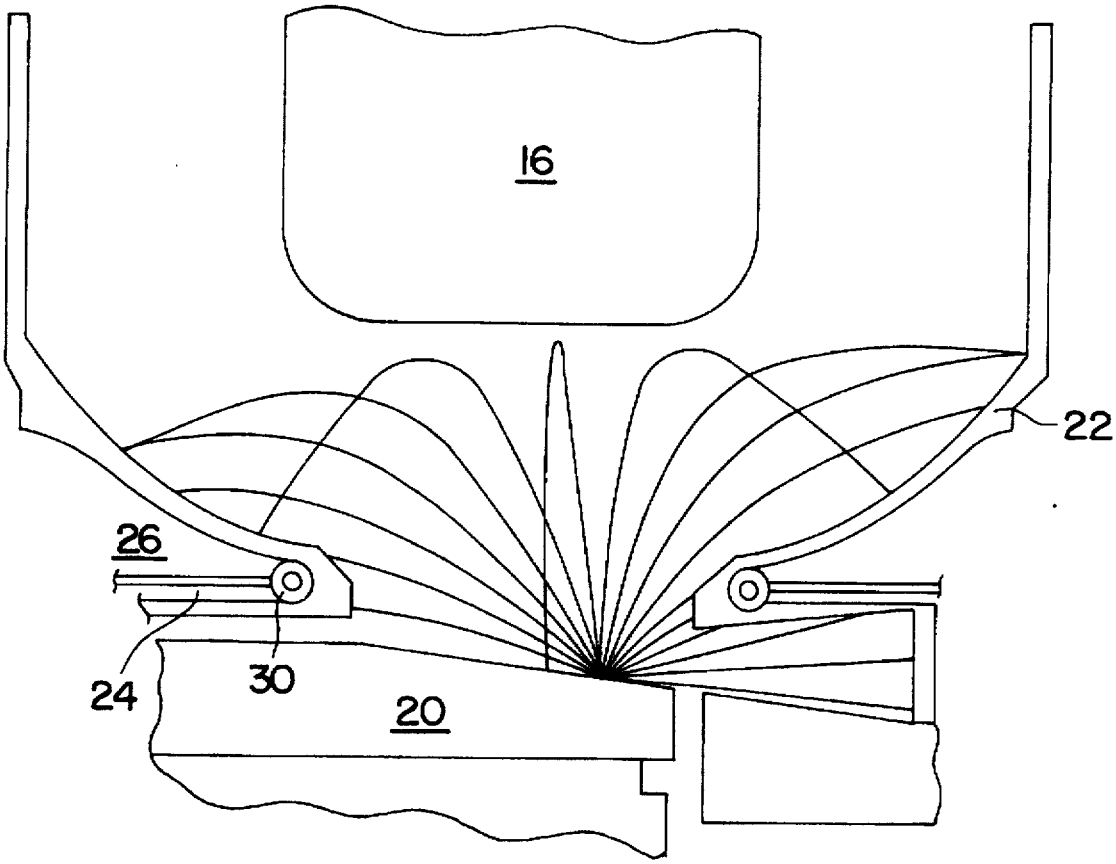
FIG. 5 is a schematic cross-sectional view of backscattering electron distribution within an evacuated envelope comprising the shield structure of the present invention.

Some heating due to secondary electron bombardment takes place on the concave portion of the shield structure, as well as at the tip. This power is convected away therefrom by the cooling fluid, resulting in a temperature rise of the fluid as it passes through the shield structure tip. The trajectory of the back-scattering electrons within the shield structure is shown in FIG. 5. It is apparent that the density of electrons hitting the shield structure is at a maximum at the tip of the structure, which requires the heat transfer enhancement provided by the coiled wires with a cooling fluid passing therethrough. The resultant increase in fluid temperature as it passes through the tip is significant. Because of the amount of liquid subcooling, the temperature difference between the bulk fluid temperature and the local saturation temperature is critical for multi-phase heat transfer, it is desirable to have the coolest fluid strike the shield structure tip first. Thus the fluid enters and exits the shield structure in the manner outlined above. After leaving the shield structure the cooling fluid enters cooling reservoir 32 positioned downstream of the shield structure, but inside the X-ray generating apparatus housing to prevent excessive fluid temperatures outside of the protective housing. The shield structure is heated during X-ray exposure and thus raises the temperature of the fluid during a limited time. During a typical exposure, the temperature rise of the fluid through the shield structure would be about 50° C., while the temperature rise of the cooling fluid due to contact with the evacuated envelope would be between 5° C. and 10° C. Since a fluid-to-air heat exchanger in the system could cool the fluid to about 15° C. measured between its inlet and its outlet, without the fluid reservoir to supply thermal mass the fluid temperature might become too high by the end of a long exposure sequence. If one considers the number of "round trips" the fluid takes through the system during the exposure sequence, 20 liters per minute flow rate and with 4 liters total fluid volume, the fluid would complete a "round trip" every 12 seconds. With every round trip the temperature would increase by a net amount of about 40° C. to 45° C. during the exposure. The data justify the solution to place a fluid reservoir downstream of the cooling block but still inside the X-ray tube housing to increase the total fluid in the system to cut the number of "round trips" to at most one during the longest exposure at maximum power, thus damping out the temperature variations of the fluid leaving the housing. The shield structure provides efficient convective heat transfer and intercepts the backscattered electrons that reduces the anode target heat load, and as a result, substantially reduces off-focal radiation. The calculations showed that the maximum heat flux of the X-ray generating apparatus will be about 1500 watts/sq cm at the inner wall of shield structure (at 72 kW power), about 600 watts/sq cm on the beveled portion of the shield structure and about 350 watts/sq cm on its concave portion. The flat portion of the shield facing the anode target receives a small amount of power by thermal radiation from the anode target and a modest contribution to the heat load due to backscattering electrons.

In the preferred embodiment the high voltage potential between the electron source and the anode target is not split, as in conventional designs, but anode-ground concept is used. It gives new opportunities for more effective anode target cooling. It eliminates the situation when the evacuated envelope is at the same electrical potential as the anode target and the back-scattered electrons strike the evacuated envelope and the X-ray window with full energy. The shield structure of the present invention being at an earth potential allows for substantial increase in the power dissipated therein. The maximum power of the X-ray generating apparatus is about 72 kW, while about 27 kW power is handled by the shield structure. The present design of the X-ray generating apparatus allows for transferring the heat from the shield structure to the cooling fluid during the exposures. The shield structure being incorporated between the electron source and the anode target protects the X-ray window from destructive heating caused by the secondary electrons and enhances the heat transfer to the cooling fluid by employing the coiled wire. The concave shape of the structure allows for effective spread of the power caused by the incident electrons over the structure so that no one region would receive greater power density than could be practically handled with the cooling means available.

It is understood that the invention is not limited to the specific forms shown. Modifications may be made in design and arrangements of the elements without departing from the spirit of the invention as expressed in the appended claims. To enhance the performance of the X-ray generating apparatus further, a selective coating is applied to the shield structure. The concave top surface facing the electron source 16 is coated with a material having a low atomic number for more effective electron collection. The bottom surface facing anode target 20 is coated with a material having a high emissivity to increase the heat transfer from the target.

What is claimed is:

1. An X-ray generating apparatus comprising:

an evacuated envelope;

an anode assembly disposed within said evacuated envelope, said anode assembly having a target;

an electron source fixedly mounted within said evacuated envelope in proximity to said anode target for generating a beam of electrons onto a surface of said target for producing X-rays;

a shield structure placed between said anode assembly and electron source, said shield structure having:

a body with an aperture for passing the electron beam, said body comprising a top surface facing said electron source, a bottom surface facing said anode target, an outer wall and an inner wall, said outer wall having higher linear dimension than said inner wall, and said inner wall defining said aperture;

a heat transfer means for increasing a velocity of said cooling fluid passing therethrough, said heat transfer means being disposed within said body proximate to said inner wall and conductively attached thereto; and inflow and outflow chambers with a septum therebetween for circulating coolant within said inflow and outflow chambers, said inflow and outflow chambers being proximate to said anode target and electron source respectively, wherein, in operation, the heat is transferred to a cooling fluid passed through said chambers.

2. The X-ray generating apparatus of claim 1, wherein said body of the shield structure is made of thermally conductive material.

3. The X-ray generating apparatus of claim 2, wherein said body has a concave top surface, and a flat bottom surface.

4. The X-ray generating apparatus of claim 1, wherein said heat transfer means is a coiled wire.

5. The X-ray generating apparatus of claim 4, wherein said velocity of said cooling fluid passing through said coiled wire is at least 4 feet/second.

6. The X-ray generating apparatus of claim 5, wherein said velocity of said cooling fluid passing through said coiled wire is at least 8 feet/second.

7. The X-ray generating apparatus of claim 6, further comprises a plurality of extended coil wires which are disposed within said outflow chamber.

8. An X-ray generating apparatus comprising:

an evacuated envelope;

a rotatable anode assembly disposed within said evacuated envelope, said anode assembly having an annular anode target;

an electron source fixedly mounted within said evacuated envelope in proximity to said anode target for generating a beam of electrons onto a surface of said target for producing X-rays; and a shield structure placed between said anode assembly and electron source, said shield structure having a heat transfer device disposed therewith for assisting in dissipating the heat from said anode assembly, and an aperture for passing said beam of electrons, said heat transfer device comprising a coiled wire, that allows the heat to be transferred to a cooling fluid passed through said coiled wire.

9. The X-ray generating apparatus of claim 8, wherein an interior of said concave top surface is knurled for increasing the cooling surface of said shield structure.

10. The X-ray generating apparatus of claim 8, wherein said shield structure has a body which is formed by a concave top surface facing said electron source, a flat bottom surface facing said anode target, an outer wall and an inner wall, said outer wall has higher linear dimension than said inner wall, and said inner wall defines said aperture.

11. The X-ray generating apparatus of claim 10, wherein said shield structure further comprises inflow and outflow chambers with a flow divider therebetween for circulating cooling fluid within said shield structure, a cross-section of said inflow chamber being substantially larger than a cross section of said outflow chamber.

12. The X-ray generating apparatus of claim 11, wherein said flow divider has an inside diameter equal to an outside diameter of said coiled wire to force said cooling fluid to flow through said coil wire in a radial direction.

13. The X-ray generating apparatus of claim 12, further comprises a fluid reservoir which is formed between said housing and said evacuated envelope, downstream of said shield structure.

14. The X-ray generating apparatus of claim 13, wherein said inflow and outflow chambers respectively comprise a pair of spaced apart entrance ports and a pair of spaced apart exit ports positioned symmetrically thereto for directing said cooling fluid in two directions to said inflow and said outflow chambers consecutively and receiving said cooling fluid by said fluid reservoir.

15. The X-ray generating apparatus of claim 14, wherein said cooling fluid flow has uniform distribution within a beveled portion of said shield structure.

16. The X-ray generating apparatus of claim 15, wherein said cooling fluid is a modified polydinethylesyloxane.

17. An X-ray generating apparatus comprising:

a protective housing;

an evacuated envelope incorporated into said housing;

a rotatable anode target disposed within said evacuated envelope;

and electron source spaced apart form said anode target;

a power supply for maintaining said electron source and anode target at respective different electrical potentials;

a shield structure placed between said rotatable anode target and electron source, said structure comprising a concave top surface facing said electron source, flat bottom surface facing said anode target, and a beveled portion surrounding an electron beam collimating aperture, said beveled portion forming a tip of said shield structure; and a coiled wire disposed within said tip of said shield structure, wherein in operation, the heat is transferred to a cooling fluid passing through said coiled wire.

18. The X-ray generating apparatus of claim 17, wherein said shield structure is at an intermediate potential of said anode target and electron source, the value of said shield structure potential being selected so as to minimize total power consumed by the X-ray generating apparatus.

19. The X-ray generating apparatus of claim 17, wherein said anode target is at earth potential.

20. The X-ray generating apparatus of claim 19, wherein said shield structure at earth potential.

21. The X-ray generating apparatus of claim 20, wherein said shield structure is made of a thermally conductive material.

22. The X-ray generating apparatus of claim 21, wherein said shield structure is made of copper.

23. The X-ray generating apparatus of claim 22, wherein said concave top surface of said shield structure is coated with a material having a low atomic number for enhancing collection electrons within said aperture of said shield structure, and said flat bottom surface of said shield structure is coated with a material having a high emissivity to increase the heat transfer from said anode target.

24. The X-ray generating apparatus of claim 23, wherein said shield structure further comprises a first and a second chamber adjacent to said top and bottom surfaces of said structure respectively and separated by a septum, each said chamber having a pair of spaced apart ports for directing said cooling fluid to each chamber in opposite directions.

25. The X-ray generating apparatus of claim 24, further comprises a fluid reservoir which is formed between said protective housing and said evacuated envelope downstream of said shielding structure and in a fluid communication therewith.

26. The X-ray generating apparatus of claim 25, wherein a flow of said cooling fluid passing through said coil has a uniform distribution along a heat transfer area of said tip of said shield structure.

27. The X-ray generating apparatus of claim 26, wherein said shield structure further comprises a plurality of extended coiled wires disposed radially therein.

28. The X-ray generating apparatus of claim 27, wherein said coiled wires are formed from a thermally conductive material.

29. The X-ray generating apparatus of claim 28, wherein each coil of said plurality of coiled wires has a circular cross-section.

30. The X-ray generating apparatus of claim 28, wherein each coil of said plurality of coil wires has a non circular cross-section.

31. The X-ray generating apparatus of claim 28, wherein an interior surface of said shield structure has a plurality of furrows to dispose a respective plurality of coiled wires therein and conductively attach thereto.

32. In an X-ray generating apparatus comprising an evacuated envelope having an electron source for generating an electron beam, said electron source fixedly mounted therein and distant apart from a rotatable anode target which decelerates the electrons for generating X-rays, a method for transferring heat from the anode target produced by the anode target when the X-ray generating apparatus in operation, comprising the steps of:

structuring a shield assembly having a body with an aperture for passing said electron beam and a divided chamber for circulating a cooling fluid therethrough, and placing said shield assembly between said anode target and said electron source; and placing at least one heat transfer device within a tip of said body for increasing the velocity of the fluid.

33. The method of clam 32, wherein the step of structuring said shield assembly comprises the steps of shaping said body so as to form a concave top surface facing said electron source, a flat bottom surface facing said anode target, inner and outer walls and a tip within said inner wall defining said aperture; and providing inflow and outflow chambers within said body with a divider therebetween for circulating coolant within said shield assembly.

34. The method of claim 33, further comprises a step of placing a plurality of the heat transfer devices within said shield assembly.

35. The method of claim 33, wherein said at least one heat transfer device is a coiled wire which is made of thermally conductive material.

* * * * *